United States Patent [19]

Gartner

[11] Patent Number: 4,525,962

[45] Date of Patent: Jul. 2, 1985

[54] APPARATUS FOR CONNECTING UPPER AND LOWER CURTAIN WALL UNITS IN A UNIT TYPE CURTAIN WALL

[75] Inventor: Karl Gartner, Gundelfingen, Fed. Rep. of Germany

[73] Assignee: Yoshida Kogyo K.K., Tokyo, Japan

[21] Appl. No.: 519,193

[22] Filed: Aug. 1, 1983

[30] Foreign Application Priority Data

Aug. 2, 1982 [JP] Japan ..... 57-133765

[51] Int. Cl.[3] ..... E04H 1/00

[52] U.S. Cl. ..... 52/235; 52/468; 52/475

[58] Field of Search ..... 52/235, 468, 475

[56] References Cited

U.S. PATENT DOCUMENTS 3,038,568 6/1962 Morgan ..... 52/475

3,994,107 11/1976 Aughuet ..... 52/235

*Primary Examiner*—Carl D. Friedman

*Attorney, Agent, or Firm*—Hill, Van Santen, Steadman & Simpson

[57] ABSTRACT

An apparatus for connecting upper and lower curtain wall units in a unit type curtain wall in which the upper curtain wall unit may be simply and easily connected to the already mounted lower curtain wall unit. The connecting apparatus comprises a connecting member having an upper portion connected to a lower horizontal frame member of an upper curtain wall unit and to a horizontal batten of the lower horizontal frame member, and further having a lower portion connected to an upper horizontal frame member of a lower curtain wall unit and to a horizontal batten of the upper horizontal frame member.

4 Claims, 5 Drawing Figures

APPARATUS FOR CONNECTING UPPER AND LOWER CURTAIN WALL UNITS IN A UNIT TYPE CURTAIN WALL

BACKGROUND OF THE INVENTION

1. Field of the Invention

This invention relates to an apparatus for connecting upper and lower limit curtain wall units in a unit type curtain wall mounted on a wall of a building in which the curtain wall units are mounted in the directions of top and bottom and left and right to steel frames.

2. Description of the Prior Art

The unit type curtain wall is a wall having such a construction that the curtain wall units are successively mounted to steel frames from a lower position of a building to an upper position thereof, and in its execution the operation for connecting the upper curtain wall unit to the already mounted lower unit curtain wall unit is very cumbersome.

SUMMARY OF THE INVENTION

The present invention has been made in view of the above-described circumstances, and an aspect of the invention is to provide an apparatus for connecting upper and lower curtain wall units in a unit type curtain wall mounted on a wall of a building in which the upper curtain wall unit may be simply and easily connected to the already mounted lower curtain wall unit.

According to the present invention, in order to achieve the foregoing aspect, there is provided with a connecting device for a pair of upper and lower curtain wall units in a unit type curtain wall mounted on a wall of a building disposed in an upper and lower positional relation wherein a mounting portion integrally provided on a relatively shorter side wall, which faces to the outside of the building, of a lower horizontal frame member of an upper curtain wall unit and a horizontal batten thereof are fixed opposedly each other in a given spaced relation and wherein a mounting portion integrally provided on a relatively shorter side wall, which faces to the outside of the building, of an upper horizontal frame member of a lower curtain wall unit and a horizontal batten thereof are fixed opposedly each other in a given spaced relation, characterized by comprising a connecting member having an upper portion connected to said lower horizontal frame member and to said horizontal batten thereof and a lower portion connected to another upper horizontal frame member and said horizontal batten thereof.

According to the present invention, there is further provided with a connecting device for a pair of upper and lower curtain wall units wherein said connecting member comprises an upper wall slightly inclined outwardly and downwardly, inner and outer walls extending substantially vertically downwardly from both edges internally and externally of said upper wall, a lower wall connected between the inner and outer walls substantially in the intermediate portion between said inner and outer walls, a protruded hook formed substantially in the intermediate portion of said upper wall to engage the inner side of said horizontal batten of said horizontal frame member, and an upper protruded piece extending vertically upwardly from the inner edge of said upper wall and which is fitted through a resilient retainer into a downwardly directed mounting groove of the mounting portion of said upper curtain wall unit, characterized in that a lower end of said inner wall is vertically displaceably fitted into an upwardly directed mounting groove of the mounting portion of said lower curtain wall unit through a resilient retainer, and a lower end of said outer wall is connected to the outer wall surface of said horizontal batten of said lower curtain wall unit through a seal through which air flows.

According to the present invention, there is still further provided with a connecting device for a pair of upper and lower curtain wall units wherein the lower end of a outer wall of said connecting member is formed as a hanging piece separately from the outer wall and is mounted in a recessed groove provided in the lower wall.

BRIEF DESCRIPTION OF THE DRAWINGS

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DESCRIPTION OF THE PREFERRED EMBODIMENT

An embodiment of the present invention will now be described with reference to the accompanying drawings.

Figure 1:
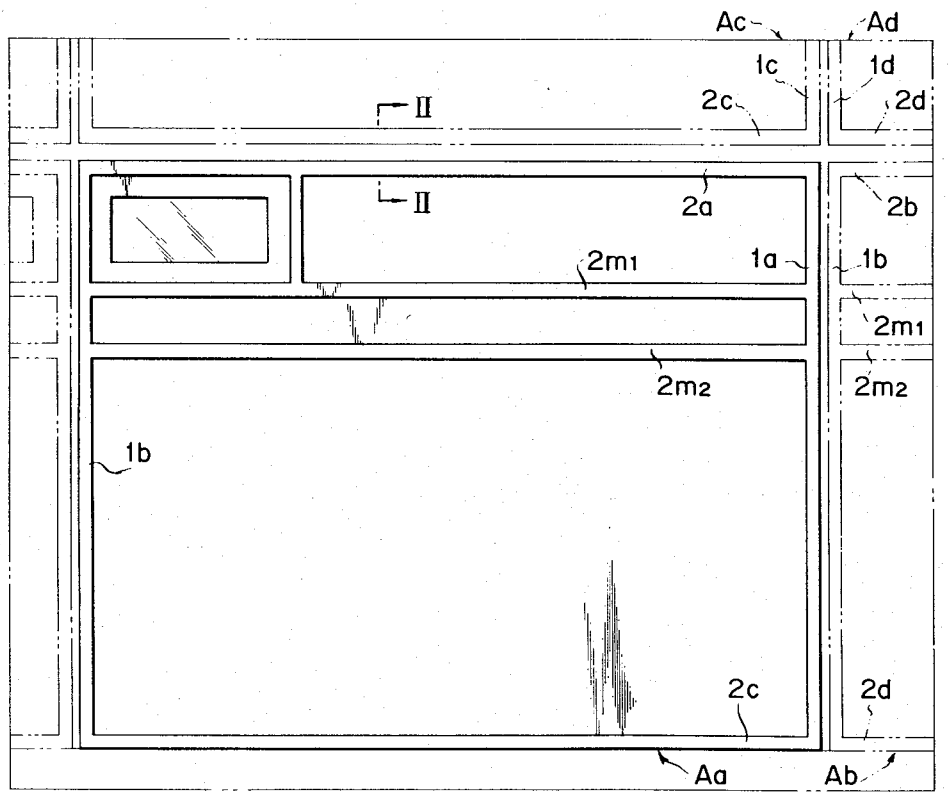
FIG. 1 is a front view showing a curtain wall.

FIG. 1 is a front view showing a curtain wall. Curtain wall units are mounted at top and bottom and to left and right to constitute a unit type curtain wall mounted on a wall of a building, a curtain wall unit Aa being formed into a square frame comprising a pair of vertical members 1*a*, 1*b*, an upper horizontal frame member 2*a*, second intermediate horizontal frame members $2m_1$, $2m_2$ and a lower horizontal member 2*c*.

Figure 2:
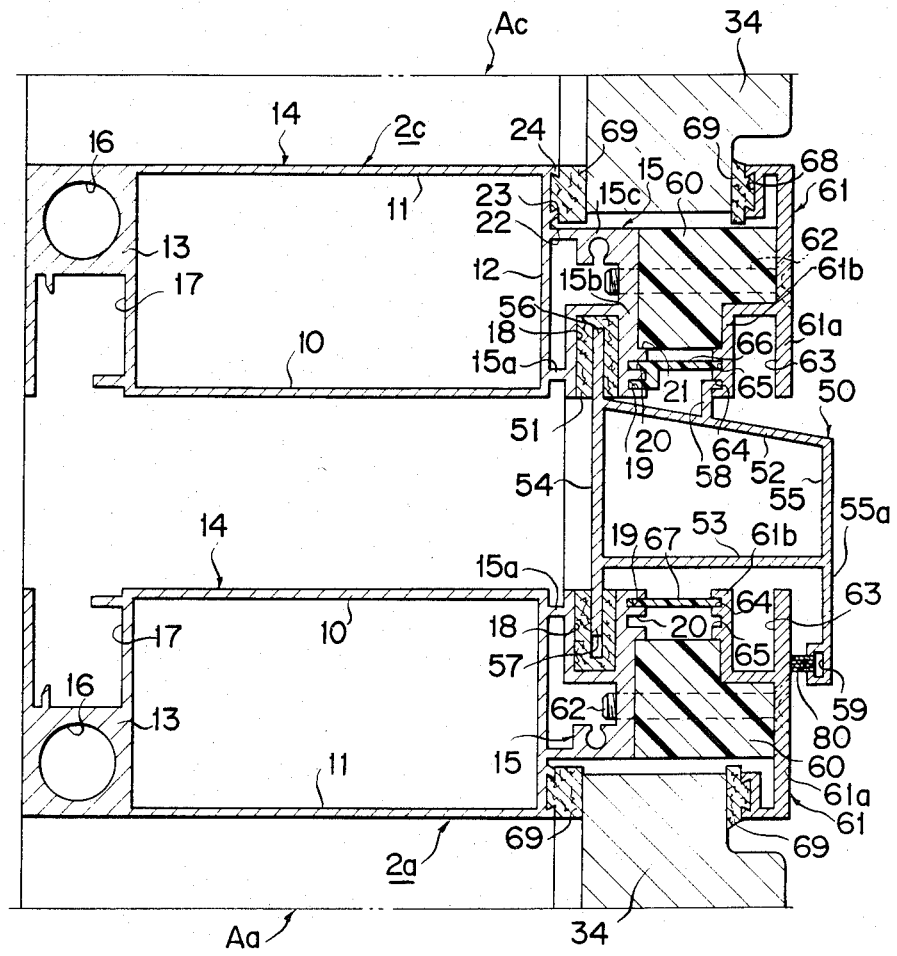
FIG. 2 is a sectional view taken on line II—II of FIG. 1.

The upper horizontal member 2*a* of the lower curtain wall unit Aa and the lower horizontal frame member 2*c* of the upper curtain wall unit Ac are connected as shown in FIG. 2.

That is, the upper horizontal frame member 2*a* of the lower curtain wall unit Aa comprises a lengthy member in the form of a substantially rectangular hollow lengthy member having as a frame thereof relatively longer opposed side walls 10, 11 perpendicular to the building wall and relatively shorter opposed side walls 12, 13 parallel to the building wall. The side wall 12 of a body 14 facing the outside of the building is formed with a mounting piece 15, while another shorter side wall 13 facing the inside of the building being formed with a longitudinally continuous hollow portion 16 and a recess 17 open to the side of the longer side wall 10. The mounting piece 15 has a Z-shaped side wall 15*a* formed with a first large mounting recess 18, an end wall 15*b* perpendicular to the Z-shaped side wall 15*a* being formed with second and third small mounting recesses 19, 20 and formed with a shoulder 21 and another side wall 15*c*. This side wall 15*c* and the shorter side wall 12 of the body 14 forms a shoulder 22, and tthe shorter side wall 12 is integrally formed with a pair of locking projections 23, 24. A batten 61 is mounted by means of a screw 62 on the end wall 15*b* in the mounting piece 15 by the interposition of a connecting member 60 formed of a heat insulating material. The batten 61 has its outer side wall 61*a* integrally formed with a bent wall 61*b* bent into a hook-shape to form a recess 63. The bent wall 61*b* is formed with fourth and fifth small recesses 64, 65 opposed to the second and third small mounting recesses 19, 20 of the mounting piece 15. The third small mounting recess 20 and the fifth small recess 64 has a connecting plate 66 formed of a heat insulating material fitted and mounted thereon.

Air tight materials 69, 69 are mounted between the pair of locking members 23, 24 and in a recess 68 formed in the outer side wall 61*a* of the batten 61, and a panel 34 is held and mounted between said air tight materials 69, 69.

The lower horizontal frame member 2*c* of the upper curtain wall unit Ac has the same shape as that of the upper horizontal frame member 2*a* of the lower curtain wall unit Aa, and they are mounted with the upper and lower portion inverted. The batten 61 is connected by means of the screw 62 by the interposition of the connecting member 60 and the connecting plate 66, and the panel 34 is held and mounted between the pair of air tight materials 69, 69.

A connecting member 50 which also serves as a flashing plate is connected over the upper horizontal frame member 2*a* and the lower horizontal frame member 2*c*.

The connecting member 50 is provided with upper and lower walls 52 and 53 and inner and outer walls 54 and 55, the upper wall 52 being inclined downward toward the outside, the inner wall 54 which is integrally formed at upper and lower portions thereof with upper and lower projections 56 and 57, the upper projection 56 being fitted and locked in the first large mounting recess 18 of the lower horizontal member 2*c* by the interposition of a downwardly directed C-shaped retaining member 51 having an elasticity, the lower projection 57 being fitted into the first large mounting recess 18 of the upper horizontal member 2*a* through an upwardly directed C-shaped retaining member 51, a hook 58 formed in the upper wall 52 engages and is locked at the fourth small recess 34, and a seal 80 mounted in a recessed groove 59 of a hanging piece 55*a* continuous to the outer wall 55 bears on the outer side wall 61*a* of the batten 61.

That is, the upper portion of the connecting member 50 is locked and secured on the side of the lower horizontal member 2*c*, and the lower portion thereof is displaceably mounted on the side of the upper horizontal member 2*a*.

Figure 5:
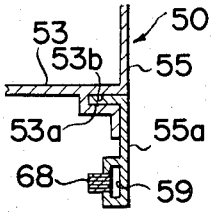
FIG. 5 is an explanatory view showing a modified form of the connecting member.

It will be noted that the outer wall 55 of the connecting member 50 and the hanging piece 55*a* can be formed separately as shown in FIG. 5, in which case, a second hook 53*a* is projected at a corner between the outer wall 55 and the lower wall 53, a recess 53*b* is formed between the hook 53*a* and the lower wall 53, and the approximately downwardly directed L-shaped hanging piece 55*a* having the recessed groove 59 with the seal provided on the extremity thereof can be made to engage the recess 53*b*.

Thus, the lower curtain wall unit Aa has been mounted, and thereafter, the upper curtain wall unit Ac is assembled and the upper portion of the connecting member 50 is locked and fixed, under the condition of which the upper curtain wall unit Ac is moved downward, the lower projection 57 of the connecting member 50 is fitted into the first large mounting recess 18 by the interposition of the retaining member 51, the seal 80 is brought into abutment with the outer side wall 61*a*, and the lower portion of the connecting member 50 is displaceably mounted on the side of the upper horizontal frame member 2*a*.

Accordingly, the upper curtain wall unit Ac may be simply and easily connected to the lower curtain wall unit Aa.

Figure 3:
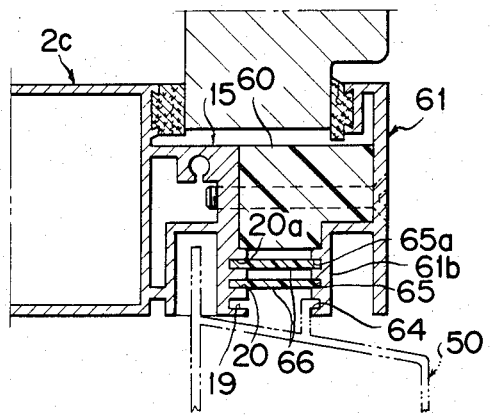
FIGS. 3 and 4 are sectional views, respectively, showing essential portions of another embodiment.

It will be noted that as shown in FIG. 3, the mounting piece 15 and the bent wall 61*b* can be formed with three mounting recesses 19, 20, 20*a* and recesses 64, 65, 65*a*, and the pair of connecting plates 66, 66 can be fitted and mounted.

In this way, the connecting strength of the batten 61 to the body 14 increases.

Figure 4:
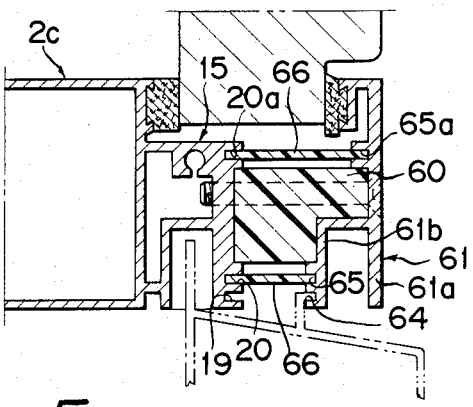

It will be further noted that as shown in FIG. 4, the mounting recess 20*a* and the recess 65*a* can be formed above the mounting piece 15 and the connecting member 60 of the bended wall 61*b*, and the connecting plate 66 can be fitted and mounted therein.

In this way, the connecting plate 66, 66 are positioned above and below the connecting member 60, and therefore, when assembled, the safety increases and the connecting strength of the batten 61 increases.

Also, the upper portion of the connecting member 50 is locked at the lower horizontal frame member 2*c* and the batten 61, and the lower portion thereof bears on the outer side wall 61*a* of the batten 61 connected to the upper horizontal frame member 2*a* through the seal 80 to thereby prevent entry of rain water or the like from the outside.

It is to be understood that the foregoing description is merely illustrative of the preferred embodiments of the prevent invention and that the scope of the invention is not to be limited thereto. Additional modifications or alterations of the invention will readily occur to one skilled in the art without departing from the scope of the invention.

What is claimed is:

1. A connecting device for a pair of upper and lower curtain wall units disposed in an upper and lower positional relation wherein a mounting portion integrally provided on a side wall of a lower horizontal frame member of an upper curtain wall unit and a horizontal batten thereof are fixed opposedly each other in a given spaced relation and wherein a mounting portion integrally provided on a side wall of an upper horizontal frame member of a lower curtain wall unit and a horizontal batten thereof are fixed opposedly each other in a given spaced relation, characterized by comprising a connecting member having an upper portion connected to said lower horizontal frame member and to said horizontal batten thereof and a lower portion connected to said upper horizontal frame member and said horizontal batten thereof, wherein said connecting member comprises an upper wall slightly inclined outwardly and downwardly, inner and outer walls extending substantially vertically downwardly from both edges internally and externally of said upper wall, a lower wall connected between the inner and outer wall, a lower wall connected between the inner and outer walls substantially in the intermediate portion between said inner and outer walls, a protruded hook formed substantially in the intermediate portion of said upper wall to engage the inner side of said horizontal batten of said horizontal member, an upper protruded piece extending vertically upwardly from the inner edge of said upper wall and which is fitted through a resilient retainer into a downwardly directed mounting groove of the mounting portion of said upper curtain wall unit, the lower end of said inner wall vertically displaceably fitted into an upwardly directed mounting groove of the mounting portion of said lower curtain wall unit through a resilient retainer, and the lower end of said outer wall connected to the outer wall surface of said horizontal batten of said lower curtain wall unit through a seal through which air flows.

2. A connecting device for a pair of upper and lower curtain wall units disposed in an upper and lower positional relation wherein a mounting portion integrally provided on a side wall of a lower horizontal frame member of an upper curtain wall unit and a horizontal batten thereof are fixed opposedly each other in a given spaced relation and wherein a mounting portion integrally provided on a side wall of an upper horizontal frame member of a lower curtain wall unit and a horizontal batten thereof are fixed opposedly each other in a given spaced relation, characterized by comprising a connecting member having an upper portion connected to said lower horizontal frame member and to said horizontal batten thereof and a lower portion connected to said upper horizontal frame member and said horizontal batten thereof, a lower end of an outer wall of said connecting member formed as a hanging piece separately from the outer wall and mounted in a recessed groove provided in a lower wall of said connecting member, said lower end being connected to the outer wall surface of said horizontal batten of said lower curtain wall through a seal through which air flows.

3. A connecting device for a pair of upper and lower curtain wall units in a unit type curtain wall mounted on a wall of a building, said units being disposed in an upper and lower positional relation and each including a substantially rectangular hollow lengthy member as a frame member having relatively shorter opposed side walls parallel to the building wall and relatively longer opposed side walls perpendicular to the building wall, wherein a first mounting portion integrally formed on one of the shorter side walls, which faces the outside of the building, of a lower horizontal frame member of said upper curtain wall unit and a first horizontal batten thereof are fixed opposedly to each other in a given spaced relation by the interposition of connecting means, and wherein a second mounting portion integrally formed on one of the shorter side walls, which faces the outside of the building, of an upper horizontal frame member of said lower curtain wall unit and a second horizontal batten thereof are fixed opposedly to each other in a given spaced relation by the interposition of connecting means, characterized in that said connecting means comprises a connecting member having an upper portion connected to said lower horizontal frame member and to said first horizontal batten thereof, a lower portion connected to said upper horizontal frame member and said second horizontal batten thereof, an upper wall slightly inclined outwardly and downwardly, inner and outer walls extending substantially vertically downwardly from both edges internally and externally of said upper wall, a lower wall connected between the inner and outer walls, a protruded hook formed in a substantially intermediate portion of said upper wall to engage the inner side of said first horizontal batten of said lower horizontal member, an upper inside protruded piece extending vertically upwardly from the inner edge of said upper wall and which is fitted through a resilient retainer into a downwardly directed mounting groove of the mounting portion of said upper curtain wall unit, a lower inside protruded piece extending vertically downwardly from the inner edge of said lower wall and which is fitted through a resilient retainer into an upwardly directed mounting groove of the mounting portion of said lower curtain wall unit, and a lower outside protruded piece extending vertically downwardly from the outer edge of said lower wall in alignment with said outer wall and connected to the outer wall surface of said second horizontal batten of said lower curtain wall unit through a seal through which air flows.

4. A connecting device for a pair of upper and lower curtain wall units according to claim 3, wherein the lower end of the lower outside protruded piece of said connecting member is formed as a hanging piece separately from the outer wall and is mounted in a recessed groove provided in the lower wall.

* * * * *